US006127977A

United States Patent [19]

Cohen

[11] Patent Number: 6,127,977

[45] Date of Patent: Oct. 3, 2000

[54] MICROSTRIP PATCH ANTENNA WITH FRACTAL STRUCTURE

[76] Inventor: Nathan Cohen, 2 Ledgewood Pl., Belmont, Mass. 02178

[21] Appl. No.: 08/965,914

[22] Filed: Nov. 7, 1997

Related U.S. Application Data

[60] Provisional application No. 60/030,633, Nov. 8, 1996.

[51] Int. Cl.[7] ..... H01Q 1/38

[52] U.S. Cl. ..... 343/700 MS; 343/792.5

[58] Field of Search ..... 343/700 MS File, 343/792.5; H01Q 1/38

[56] References Cited

U.S. PATENT DOCUMENTS

| | | | |
|---|---|---|---|
| 4,652,889 | 3/1987 | Bizouard et al. | 343/700 MS |
| 5,006,858 | 4/1991 | Shirosaka | 343/700 |
| 5,111,211 | 5/1992 | Dahlberg | 343/700 MS |
| 5,313,216 | 5/1994 | Wang et al. | 343/700 MS |
| 5,453,752 | 9/1995 | Wang et al. | 343/700 MS |

*Primary Examiner*—Michael C. Wimer

*Attorney, Agent, or Firm*—Flehr Hohbach Test Albritton & Herbert LLP

[57] ABSTRACT

A microstrip patch antenna having reduced size is implementing by providing a substrate having on one surface a conductive fractal pattern, and having on the other surface a conductive pattern that may (but need not) also be a fractal pattern. The fractal pattern is of order N≧1, and if fractal patterns are formed on each substrate surface, the fractal family and fractal iteration number may be different. So fractalizing at least one conductive surface permits reduction of substrate dimension may be reduced to one-eighth wavelength.

26 Claims, 1 Drawing Sheet

MICROSTRIP PATCH ANTENNA WITH FRACTAL STRUCTURE

RELATION TO PREVIOUSLY FILED PATENT APPLICATIONS

This application claims priority from applicant's U.S. provisional patent application No. 60/030,633 filed Nov. 8, 1996 entitled "MICROSTRIP PATCH ANTENNAE INCORPORATING 1 AND/OR 2 SIDES OF FRACTAL STRUCTURE ELEMENTS".

Applicant also refers to and incorporates herein by reference applicant's U.S. application Ser. No. 08/649,825 filed May 17, 1996 entitled "FRACTAL ANTENNA GROUND COUNTERPOISE, GROUND PLANES, AND LOADING ELEMENTS", now abandoned, applicant's patent application Ser. No. 08,609,514 filed Mar. 1, 1996 entitled "TUNING FRACTAL ANTENNAS AND FRACTAL RESONATORS", now abandoned, and applicant's patent application Ser. No. 08/512,954 filed Aug. 9, 1995 entitled "FRACTAL ANTENNAS AND FRACTAL RESONATORS", now abandoned.

FIELD OF THE INVENTION

The present invention relates to microstrip patch antennas and more specifically to providing such antennas with fractal structure elements.

BACKGROUND OF THE INVENTION

Antenna are used to radiate and/or receive typically electromagnetic signals, preferably with antenna gain, directivity, and efficiency. Practical antenna design traditionally involves trade-offs between various parameters, including antenna gain, size, efficiency, and bandwidth.

Antenna design has historically been dominated by Euclidean geometry. In such designs, the closed antenna area is directly proportional to the antenna perimeter. For example, if one doubles the length of an Euclidean square (or "quad") antenna, the enclosed area of the antenna quadruples. Classical antenna design has dealt with planes, circles, triangles, squares, ellipses, rectangles, hemispheres, paraboloids, and the like, (as well as lines).

With respect to antennas, prior art design philosophy has been to pick a Euclidean geometric construction, e.g., a quad, and to explore its radiation characteristics, especially with emphasis on frequency resonance and power patterns. The unfortunate result is that antenna design has far too long concentrated on the ease of antenna construction, rather than on the underlying electromagnetics.

Many prior art antennas are based upon closed-loop or island shapes. Experience has long demonstrated that small sized antennas, including loops, do not work well, one reason being that radiation resistance ("R") decreases sharply when the antenna size is shortened. A small sized loop, or even a short dipole, will exhibit a radiation pattern of ½λ and ¼λ, respectively, if the radiation resistance R is not swamped by substantially larger ohmic ("O") losses. Ohmic losses can be minimized using impedance matching networks, which can be expensive and difficult to use. But although even impedance matched small loop antennas can exhibit 50% to 85% efficiencies, their bandwidth is inherently narrow, with very high Q, e.g., Q>50. As used herein, Q is defined as (transmitted or received frequency)/(3 dB bandwidth).

Applicant's above-referenced co-pending patent applications depict examples of fractal geometry, which geometry may be grouped into random fractals, which are also termed chaotic or Brownian fractals and include a random noise components, or deterministic fractals.

In deterministic fractal geometry, a self-similar structure results from the repetition of a design or motif (or "generator"), on a series of different size scales. One well known treatise in this field is *Fractals, Endlessly Repeated Geometrical Figures*, by Hans Lauwerier, Princeton University Press (1991), which treatise applicant refers to and incorporates herein by reference. Lauwerier notes that in its replication, the motif may be rotated, translated, scaled in dimension, or a combination of any of these characteristics. Thus, as used herein, second order of iteration or N=2 means the fundamental motif has been replicated, after rotation, translation, scaling (or a combination of each) into the first order iteration pattern. A higher order, e.g., N=3, iteration means a third fractal pattern has been generated by including yet another rotation, translation, and/or scaling of the first order motif.

Unintentionally, first order fractals have been used to distort the shape of dipole and vertical antennas to increase gain, the shapes being defined as a Brownian-type of chaotic fractals. See F. Landstorfer and R. Sacher, *Optimisation of Wire Antennas*, J. Wiley, New York (1985).

So-called microstrip patch antennas have traditionally been fabricated as two spaced-apart metal surfaces separated by a small width dielectric. The sides are dimensioned typically one-quarter wavelength or one-half wavelength at the frequency of interest. One surface is typically a simple euclidean structure such as a circle, a square, while the other side is a ground plane.

Attempting to reduce the physical size of such an antenna for a given frequency typically results in a poor feedpoint match (e.g., to coaxial or other feed cable), poor radiation bandwidth, among other difficulties.

Prior art antenna design does not attempt to exploit multiple scale self-similarity of real fractals. This is hardly surprising in view of the accepted conventional wisdom that because such antennas would be anti-resonators, and/or if suitably shrunken would exhibit so small a radiation resistance R, that the substantially higher ohmic losses O would result in too low an antenna efficiency for any practical use. Further, it is probably not possible to mathematically predict such an antenna design, and high order iteration fractal antennas would be increasingly difficult to fabricate and erect, in practice.

Thus, the use of fractals, especially higher order fractals, in fabricating microstrip patch antennas has not been investigated in the prior art.

Applicant's above-noted FRACTAL ANTENNA AND FRACTAL RESONATORS patent application provided a design methodology to produce smaller-scale antennas that exhibit at least as much gain, directivity, and efficiency as larger Euclidean counterparts. Such design approach should exploit the multiple scale self-similarity of real fractals, including N≧2 iteration order fractals. Further, said application disclosed a non-Euclidean resonator whose presence in a resonating configuration can create frequencies of resonance beyond those normally presented in series and/or parallel LC configurations. Applicant's above-noted TUNING FRACTAL ANTENNAS AND FRACTAL RESONATORS patent application provided devices and methods for tuning and/or adjusting such antennas and resonators. Said application further disclosed the use of non-Euclidean resonators whose presence in a resonating configuration could create frequencies of resonance beyond those normally presented in series and/or parallel LC configurations.

However, such antenna design approaches and tuning approaches should also be useable with microstrip patch antennas and elements for such antennas. Thus, there is a need for a method by which microstrip patch antennas could be made smaller without sacrificing antenna bandwidth, while preserving good feedpoint impedance matching, and while maintaining acceptable gain and frequency characteristics.

The present invention provides such microstrip patch antennas, and elements for such antennas.

SUMMARY OF THE INVENTION

The present invention provides a microstrip patch antenna comprising spaced-apart first and second conductive surfaces separated by a dielectric material. The dielectric material thickness preferably is substantially less than one wavelength for the frequency of interest.

At least one of the surfaces is fabricated to define a fractal pattern of first or higher iteration order. Overall dimensions of the surfaces may be reduced below the one-quarter to one-half wavelength commonly found in the prior art.

Radio frequency feedline coupling to the microstrip patch antenna may be made at a location on the antenna pattern structure, or through a conductive feedtab strip that may be fabricated along with the conductive pattern on one or both surfaces of the antenna. The resultant antenna may be sized smaller than a non-fractal counterpart (e.g., approximately one-eighth wavelength provides good performance at about 900 MHz.) while preserving good, preferably 50Ω, feedpoint impedance. Further bandwidth can actually be increased, and resonant frequency lowered.

Other features and advantages of the invention will appear from the following description in which the preferred embodiments have been set forth in detail, in conjunction with the accompanying drawings.

DETAILED DESCRIPTION OF THE PREFERRED EMBODIMENTS

In overview, the present invention provides a microstrip patch antenna with at least one element whose shape, at least is part, is substantially a fractal of iteration order $N \geqq 1$. The resultant antenna is smaller than its Euclidean counterpart, provides close to 50Ω termination impedance, exhibits acceptable gain, increased bandwidth, and decreased resonant frequency than its Euclidean counterpart.

In contrast to Euclidean geometric antenna design, a fractal antenna ground counterpoise according to the present invention has a perimeter that is not directly proportional to area. For a given perimeter dimension, the enclosed area of a multi-iteration fractal area will always be at least as small as any Euclidean area.

Using fractal geometry, the ground element has a self-similar structure resulting from the repetition of a design or motif (or "generator"), which motif is replicated using rotation, translation, and/or scaling (or any combination thereof). The fractal portion of the element has x-axis, y-axis coordinates for a next iteration N+1 defined by $x_{N+1}=f(x_N, yb_N)$ and $y_{N+1}=g(x_N, y_N)$, where $x_N$, $y_N$ are coordinates of a preceding iteration, and where f(x,y) and g(x,y) are functions defining the fractal motif and behavior.

For example, fractals of the Julia set may be represented by the form:

$$x_{N+1}=x_N^2-y_N^2+a$$

$$y_{N+1}=2x_N y_N=b$$

In complex notation, the above may be represented as:

$$Z_{N+1}=Z_N^2+C$$

Although it is apparent that fractals can comprise a wide variety of forms for functions f(x,y) and g(x,y), it is the iterative nature and the direct relation between structure or morphology on different size scales that uniquely distinguish f(x,y) and g(x,y) from non-fractal forms. Many references including the Lauwerier treatise set forth equations appropriate for f(x,y) and g(x,y).

Iteration (N) is defined as the application of a fractal motif over one size scale. Thus, the repetition of a single size scale of a motif is not a fractal as that term is used herein. Multi-fractals may of course be implemented, in which a motif is changed for different iterations, but eventually at least one motif is repeated in another iteration.

Figure 1:
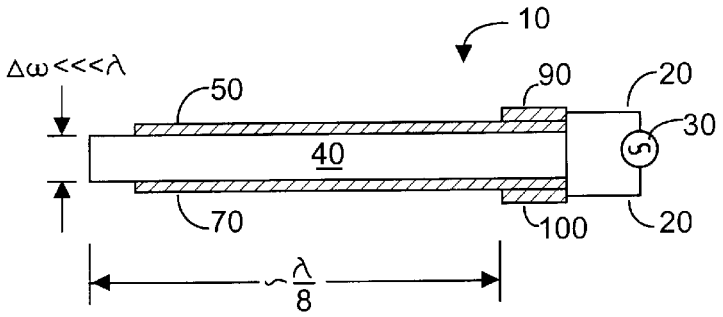
FIG. 1 is a sideview of a microstrip patch antenna with at least one fractal element, according to the present invention.

Referring now to FIG. 1, a microstrip patch antenna 10 according to the present invention is shown coupled by coaxial or other cable (or equivalent) 20 to a source of radio frequency 30. Antenna 10 comprises a substrate 40 whose top-to-bottom thickness is preferably substantially less than one wavelength at the frequency of interest, e.g., the radio frequency or band of radio frequencies coupled by cable 20 to antenna 10. Preferably the effective dimension of substrate is one-eighth wavelength at such frequency.

On its first surface, substrate 40 is initially covered by a conductive layer of material 50 that is etched away or otherwise removed in areas other than the desired fractal pattern (60) design, to expose the substrate. The remaining conductive trace portion defines a fractal element, according to the present invention.

Similarly on its second surface, substrate 40 is initially covered by a conductive layer of material 70 that is selectively removed so as to leave a desired pattern (80) that may also be a fractal pattern, according to the present invention. Alternatively, conductive material defining the desired patterns 60, 80 could be deposited upon substrate 40, rather than beginning fabrication with a substrate clad or otherwise having conductive surfaces, portions of which are removed.

Preferably feedtabs 90 and 100 are coupled, respectively, to edge regions of the first and second surfaces of substrate 40 to facilitate electrical radio frequency coupling between cable 20 and patterns 60 and/or 80. These feedtabs preferably are etched using the same conductive material originally found on the upper or lower surfaces of substrate 40, or may otherwise be formed using techniques known to those skilled in the relevant art. If patterns 60 and 80 are deposited rather than etched, then feedtabs 90, 100 may be deposited at the same fabrication step.

Substrate 40 is a non-conductive material, and by way of example may be a silicon wafer, a rigid or a flexible plastic-like material, perhaps Mylar™ material, or the non-conductive portion of a printed circuit board, paper, epoxy, among other materials. The original conductive material on the first and/or second surfaces may be deposited doped polysilicon for a semiconductor substrate 40, or copper (or other conductor) for a printed circuit board substrate.

Figure 2:
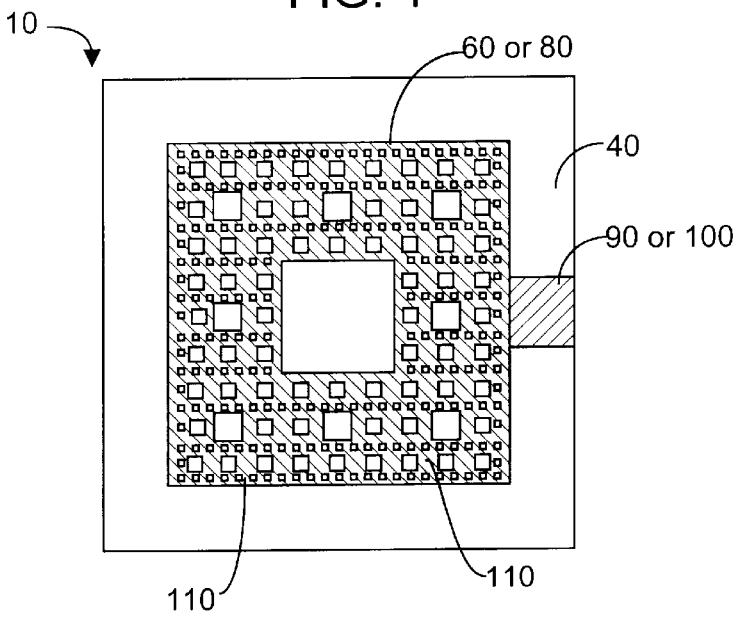
FIG. 2 is a top plan view of an exemplary fractal element (a Sierpinski square gasket, including an optional feedtab, according to the present invention.

FIG. 2 is a plan view of one surface of antenna 10 (it matters not which), and depicts a first iteration fractal conductive pattern, although a fractal pattern with higher than first iteration could instead be used. The pattern shown in FIG. 2 is often referred to as a Siepinski (square) gasket pattern. A margin is shown in FIG. 2 between the outer perimeter of the pattern and the edge of the substrate; however no such margin is required. Although FIG. 2 shows inclusion of feedtab 90 or 100, radio frequency feed may be made elsewhere on the surface, for example at any point 110.

If the fractal pattern of FIG. 2 represents one surface of antenna 10, the opposite surface need not define a fractal pattern, but may in fact do so. For example, one surface may define a fractal pattern and the opposite surface may be entirely conductive, or may define on the substrate a conductive circle, etc. If the pattern on the opposite surface is also a fractal, there is no requirement that it be the same iteration fractal as is defined on the first surface, or that it be the same fractal type. While common fractal families include Koch, Minkowski, Julia, diffusion limited aggregates, fractal trees, Mandelbrot, microstrip patch antennas with fractal element(s) according to the present invention may be implemented with other fractals as well.

Figure 3:
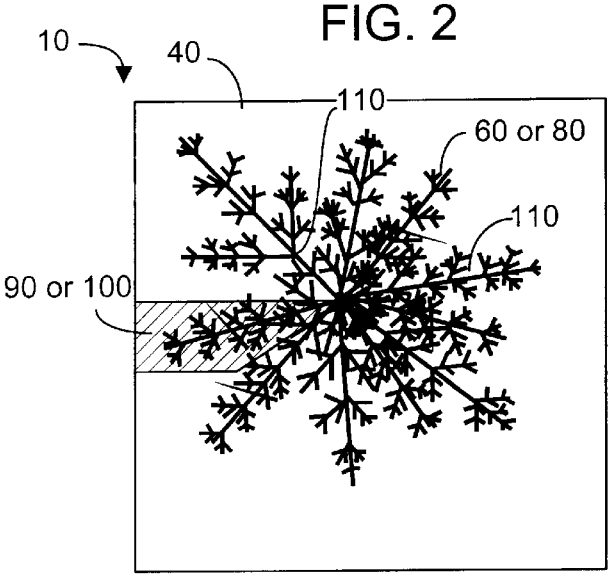
FIG. 3 is a top plan view of an exemplary alternative fractal element (a diffusion limited aggregate), including an optional feed pad, according to the present invention.

FIG. 3 depicts a pattern 60 or 80 in which a different fractal pattern is defined, a so-called diffusion limited aggregate pattern. It is understood, however, that according to the present invention, a great variety of fractal patterns of first or higher iteration may be defined on the first and/or second surface of antenna 10. In FIG. 3, while a feedtab 90 or 100 is shown, it is again understood that radio frequency feed may be made essentially anywhere on the fractal pattern, e.g., at a point 110.

In one embodiment, applicant fabricated an antenna 10 having sides dimensioned to about one-eighth wavelength for a frequency of about 900 MHz. Those skilled in the art will readily appreciate that a microstrip patch antenna dimensioned to one-eighth wavelength is substantially smaller than prior art non-fractal microstrip patch antennas, in which dimensions are one-quarter or one-half wavelength in size. At 900 MHz, bandwidth was about 5% to about 8% of nominal frequency. Gain and matching impedance were acceptable, and indeed substantially 50Ω impedance is realized without the need for impedance transforming devices.

Modifications and variations may be made to the disclosed embodiments without departing from the subject and spirit of the invention as defined by the following claims. It will be appreciated, for example, that the present invention may be implemented and adjusted and used in ways described in any of applicant's referenced co-pending applications.

What is claimed is:

1. A microstrip patch antenna including:

a substrate having spaced-apart first and second surfaces, said substrate having a thickness substantially smaller than a wavelength at a frequency to be coupled to said antenna;

a conductive pattern defining a fractal of iteration order N disposed on the first surface, wherein said fractal is defined as a superposition over at least N=1 interations of a motiff, an iteration being placement of said motif upon a base figure through at least one positioning selected from a group consisting of (i) rotation, (ii) stretching, and (iii) translation;

wherein said motif is selected from a group consisting of (i) Koch, (ii) Minkowski, (iii) Cantor, (iv) torn square, (v) Mandelbrot, (vi) Caley tree, (vii) monkey's swing, (viii) Sierpinski gasket, and (ix) Julia; and a conductive pattern disposed on the second surface.

2. The antenna of claim 1, wherein said pattern on said second surface defines a fractal.

3. The antenna of claim 1, wherein said motif has x-axis, y-axis coordinates for a next iteration N+1 defined by $x_{N+1}=f(x_N, y_N)$ and $y_{N+1}=g(x_N, y_N)$, where $x_N$, $y_N$ are coordinates for iteration N, and where f(x,y) and g(x,y) are functions defining said motif.

4. The antenna of claim 1, wherein said antenna has a perimeter compression parameter (PC) defined by:

$$PC = \frac{\text{full-sized antenna element length}}{\text{fractal-reduced antenna element length}}$$

where:

$$PC=A\cdot\log\,[N(D+C)]$$

in which A and C are constant coefficients for a given said motif, N is an iteration number, and D is a fractal dimension given by log(L)/log(r), where L and r are one-dimensional antenna element lengths before and after fractalization, respectively.

5. The antenna of claim 1, in which said antenna is fabricated in a manner selected from the group consisting of (i) forming upon an insulator substrate a conductive layer defining said fractal, (ii) forming upon a flexible insulator substrate a conductive layer defining said fractal; (iii) forming upon a semiconductor substrate a layer of conductive material to define said fractal, and (iv) removing from a substrate having a surface covered with conductive material a portion of said conductive material to form said fractal.

6. The antenna of claim 1, wherein said substrate is sized to less than one-quarter wavelength at a frequency of radio frequency signals to be coupled to said antenna.

7. The antenna of claim 1, wherein said substrate is sized to approximately one-eighth wavelength at a frequency of radio frequency signals to be coupled to said antenna.

8. The antenna of claim 7, wherein said frequency is approximately 900 MHz.

9. A microstrip patch antenna including:

a substrate having spaced-apart first and second surfaces, said substrate having a thickness substantially smaller than a wavelength at a frequency to be coupled to said antenna;

a conductive pattern defining a fractal of iteration order N disposed on the first surface, where said fractal is defined as a superposition over at least N=1 interations of a motiff, an iteration being placement of said motif upon a base figure through at least one positioning selected from a group consisting of (i) rotation, (ii) stretching, and (iii) translation;

wherein said antenna has a perimeter compression parameter (PC) defined by:

$$PC = \frac{\text{full-sized antenna element length}}{\text{fractal-reduced antenna element length}}$$

where:

$$PC=A\cdot\log\,[N(D+C)]$$

in which A and C are constant coefficients for a given said motif, N is an iteration number, and D is a fractal dimension given by log(L)/log(r), where L and r are one-dimensional antenna element lengths before and after fractalization respectively; and a conductive pattern disposed on the second surface.

10. The antenna of claim 9, wherein said motif is selected from a family consisting of (i) Koch, (ii) Minkowski, (iii) Cantor, (iv) torn square, (v) Mandelbrot, (vi) Caley tree, (vii) monkey's swing, (viii) Sierpinski gasket, and (ix) Julia.

11. A method of fabricating a microstrip patch antenna, the method including the following steps:

(a) providing a substrate having spaced-apart first and second surfaces and having a substrate thickness substantially smaller than a wavelength at a frequency to be coupled to said antenna;

(b) disposing on the first surface of said substrate a conductive pattern defining a fractal of iteration order N formed; and (c) disposing on the second surface of said substrate a conductive pattern;

wherein said motif is selected from a family consisting of (i) Koch, (ii) Minkowski, (iii) Cantor, (iv) torn square, (v) Mandelbrot, (vi) Caley tree, (vii) monkey's swing, (viii) Sierpinski gasket, and (ix) Julia.

12. The method of claim 11, wherein at step (c) said conductive pattern is formed so as to define a fractal.

13. The method of claim 11, wherein at step (b), said fractal on said first surface is defined as a superposition over at least N=1 iterations of a motif, an iteration being placement of said motif upon a base figure through at least one positioning selected from the group consisting of (i) rotation, (ii) stretching, and (iii) translation.

14. The method of claim 11, wherein said motif has x-axis, y-axis coordinates for a next iteration N+1 defined by $x_{N+1}=f(x_N, y_N)$ and $y_{N+1}=g(x_N, y_N)$, where $x_N$, $y_N$ are coordinates for iteration N, and where f(x,y) and g(x,y) are functions defining said motif.

15. The antenna of claim 9, wherein said antenna is fabricated in a manner selected from the group consisting of (i) forming upon an insulator substrate a conductive layer defining said fractal, (ii) forming upon a flexible insulator substrate a conductive layer defining said fractal; (iii) forming upon a semiconductor substrate a layer of conductive material to define said fractal, and (iv) removing from a substrate having a surface covered with conductive material a portion of said conductive material to form said fractal.

16. The method of claim 11, wherein said antenna has a perimeter compression parameter (PC) defined by:

$$PC = \frac{\text{full-sized antenna element length}}{\text{fractal-reduced antenna element length}}$$

where:

$$PC=A\cdot\log\,[N(D+C)]$$

in which A and C are constant coefficients for a given said motif, N is an iteration number, and D is a fractal dimension given by log(L)/log(r), where L and r are one-dimensional antenna element lengths before and after fractalization, respectively.

17. The method of claim 11, in which said antenna is fabricated in a manner selected from the group consisting of (i) forming upon an insulator substrate a conductive layer defining said fractal, (ii) forming upon a flexible insulator substrate a conductive layer defining said fractal; (iii) forming upon a semiconductor substrate a layer of conductive material to define said fractal, and (iv) providing a substrate having a surface covered with conductive material, and removing a portion of said conductive material to form said fractal.

18. The method of claim 11, wherein said substrate is sized to less than one-quarter wavelength at a frequency of radio frequency signals to be coupled to said antenna.

19. The method of claim 11, wherein at step (a) said substrate is sized to approximately one-eighth wavelength at a frequency of radio frequency signals to be coupled to said antenna.

20. The method of claim 19, wherein said frequency is approximately 900 MHz.

21. A method of fabricating a microstrip patch antenna, the method including the following steps:

(a) providing a substrate having spaced-apart first and second surfaces and having a substrate thickness substantially smaller than a wavelength at a frequency to be coupled to said antenna;

(b) disposing on the first surface of said substrate a conductive pattern defining a fractal of iteration order N formed; and (c) disposing on the second surface of said substrate a conductive pattern;

wherein said antenna has a perimeter compression parameter (PC) defined by:

$$PC = \frac{\text{full-sized antenna element length}}{\text{fractal-reduced antenna element length}}$$

where:

$$PC=A\cdot\log\,[N(D+C)]$$

in which A and C are constant coefficients for a given said motif, N is an iteration number, and D is a fractal dimension given by log(L)/log(r), where L and r are one-dimensional antenna element lengths before and after fractalization, respectively.

22. The method of claim 21, wherein at step (c) said conductive pattern is formed so as to define a fractal.

23. The method of claim 21, wherein said antenna is fabricated in a manner selected from the group consisting of (i) forming upon an insulator substrate a conductive layer defining said fractal, (ii) forming upon a flexible insulator substrate a conductive layer defining said fractal; (iii) forming upon a semiconductor substrate a layer of conductive material to define said fractal, and (iv) providing a substrate having a surface covered with conductive material, and removing a portion of said conductive material to form said fractal.

24. The method of claim 21, wherein said substrate is sized to less than one-quarter wavelength at a frequency of radio frequency signals to be coupled to said antenna.

25. The method of claim 21, wherein at step (a) said substrate is sized to approximately one-eighth wavelength at a frequency of radio frequency signals to be coupled to said antenna.

26. The method of claim 25, wherein said frequency is approximately 900 MHz.

* * * * *